US009920900B2

(12) United States Patent
Bjørn

(10) Patent No.: US 9,920,900 B2
(45) Date of Patent: Mar. 20, 2018

(54) MARITIME LIGHT SOURCE

(75) Inventor: Lars Nørgaard Bjørn, Rønde (DK)

(73) Assignee: Daniamant APS, Slangerup (DK)

( * ) Notice: Subject to any disclaimer, the term of this patent is extended or adjusted under 35 U.S.C. 154(b) by 0 days.

(21) Appl. No.: 13/812,254

(22) PCT Filed: Jul. 25, 2011

(86) PCT No.: PCT/EP2011/062713
§ 371 (c)(1),
(2), (4) Date: Jan. 25, 2013

(87) PCT Pub. No.: WO2012/013618
PCT Pub. Date: Feb. 2, 2012

(65) Prior Publication Data

US 2013/0128600 A1 May 23, 2013

Related U.S. Application Data

(60) Provisional application No. 61/367,593, filed on Jul. 26, 2010.

(30) Foreign Application Priority Data

Jul. 26, 2010 (DK) ..... 2010 70340

(51) Int. Cl.

| | |
|---|---|
| ***F21V 29/00*** | (2015.01) |
| ***F21V 5/04*** | (2006.01) |
| ***F21V 15/01*** | (2006.01) |
| ***F21V 23/04*** | (2006.01) |
| ***F21V 31/00*** | (2006.01) |
| ***F21V 33/00*** | (2006.01) |

(Continued)

(52) U.S. Cl.
CPC ..... *F21V 5/04* (2013.01); *F21V 15/01* (2013.01); *F21V 23/04* (2013.01);
(Continued)

(58) Field of Classification Search
CPC ..... F21V 23/0442; F21V 31/005; F21V 33/0064; F21V 15/01; F21W 2101/04; F21W 2111/10
(Continued)

(56) References Cited

U.S. PATENT DOCUMENTS 5,894,611 A 4/1999 Toro
6,203,173 B1 3/2001 Duff et al.
(Continued)

FOREIGN PATENT DOCUMENTS

CA 2588301 A1 11/2008
CN 2896014 Y 5/2007
(Continued)

OTHER PUBLICATIONS

International Search Report for PCT/EP2011/062713 dated Feb. 7, 2012.
Danish Search Report for PCT/EP2011/062713 dated Mar. 10, 2011.

*Primary Examiner* — Evan Dzierzynski
(74) *Attorney, Agent, or Firm* — Harness, Dickey & Pierce, P.L.C.

(57) ABSTRACT

The present invention relates to a maritime light source comprising a bottom housing and a lid attached thereto. The lid comprises an integrated lens portion and a button portion, wherein the lens portion is adapted to scatter light from an associated light source over an angle of at least 160 degrees in a substantially uniform manner. The button portion comprises an integrated and flexible push button membrane. A water proof sealing is formed between the bottom housing and the lid.

14 Claims, 14 Drawing Sheets a) b) c) d) e)

(51) Int. Cl.

| | |
|---|---|
| *F21L 4/00* | (2006.01) |
| *F21W 101/04* | (2006.01) |
| *F21W 111/10* | (2006.01) |
| *F21Y 115/10* | (2016.01) |

(52) U.S. Cl.
CPC ..... *F21V 23/0442* (2013.01); *F21V 31/005* (2013.01); *F21V 33/0064* (2013.01); *F21L 4/00* (2013.01); *F21W 2101/04* (2013.01); *F21W 2111/10* (2013.01); *F21Y 2115/10* (2016.08)

(58) Field of Classification Search
USPC ..... 362/477, 267, 108
See application file for complete search history.

(56) References Cited

U.S. PATENT DOCUMENTS

| | | | | |
|---|---|---|---|---|
| 6,547,414 | B2 | 4/2003 | Steger | |
| 6,971,761 | B2 | 12/2005 | Parsons | |
| 2001/0014021 | A1 | 8/2001 | Duff et al. | |
| 2001/0015893 | A1 | 8/2001 | Campman | |
| 2004/0150987 | A1* | 8/2004 | Shaw | 362/108 |
| 2005/0047122 | A1* | 3/2005 | Kuo | 362/158 |
| 2007/0048527 | A1* | 3/2007 | Agarwal | B32B 27/08 428/412 |
| 2008/0205049 | A1* | 8/2008 | Brain | 362/158 |
| 2009/0109677 | A1* | 4/2009 | Coushaine et al. | 362/267 |
| 2011/0211331 | A1* | 9/2011 | Alkjaer | 362/20 |
| 2012/0033411 | A1* | 2/2012 | Heo | 362/108 |

FOREIGN PATENT DOCUMENTS

| | | | |
|---|---|---|---|
| CN | 2896017 | Y | 5/2007 |
| CN | 200978001 | Y | 11/2007 |
| CN | 201077526 | Y | 6/2008 |
| EP | 0994293 | A2 | 4/2000 |
| EP | 1679258 | A2 | 7/2006 |
| JP | 7314580 | A | 12/1995 |
| RU | 2355599 | C1 | 5/2009 |
| WO | WO-2009/054898 | A1 | 4/2009 |

* cited by examiner a) b) c) d) e)

a)

b)

a)

b)

a)

b)

a)

b)

MARITIME LIGHT SOURCE

This application claims priority under 35 U.S.C. § 120 to International Application No. PCT/EP2011/062713, with an International filing date of Jul. 25, 2011; which further claims priority to U.S. Provisional Application No. 61/367,593, filed Jul. 26, 2010, and to Denmark Application No. PA 2010 70340, filed Jul. 26, 2010.

FIELD OF THE INVENTION

The present invention relates to a maritime light source suitable for being used as a life jacket or raft emergency light source. In particular, the present invention relates to a maritime life source offering the following functionalities: Belt version with manual on/off light activation, belt version with manual & water on/off light activation, built-in version with manual on/off light activation, built-in version with manual & water on/off light activation, and built-in version with manual on/off light activation and external water light activation.

BACKGROUND OF THE INVENTION

Life jackets and rafts which are held in readiness aboard vessels and aircraft are usually in a tightly packed condition until inflated for use. The inflation is preferably carried out automatically even though it may also be carried out manually.

Before being put into use a light source arranged on life jackets or rafts should be switched on by supplying power from a long-storage-life battery. The light source may be switched on manually but, of course, it is desirable that it is switched on automatically when the life jacket or raft is exposed to water.

In order to comply with international demands the light source of a life jacket or a raft should be capable of flashing the light source between 50 and 70 times per minute for a period of at least 8 hours. The typical switching sequence involves that the light source is switched on in period of 0.3 s. This on-period is followed by a period of 0.7 s where the light source is switched off. During the full 8 hours the lamp should be capable of delivery a light intensity of 0.75 candela.

It is a disadvantage of known systems that the light intensity from the lamp decreases over time. This decrease in light intensity is primarily caused by a decreasing battery voltage which in known devices may decrease up to 30% over 8 hours. In case of for example a 3 V lithium battery, the battery voltage may decrease down to around 2 V over a period of 8 hours. Initially, the battery voltage is sufficient to drive the light source so that it generates a light intensity that exceeds international demands (0.75 candela) with a relative large margin. However, due to the decreasing battery voltage over time, the generated light intensity decreases accordingly whereby the safety margin to the required 0.75 candela is reduced as well.

Moreover, scattering of light over approximately 180 degrees, which correspond to a hemisphere, has proven difficult without implemented a relatively high lens structure. However, high lens structures are disadvantageous in maritime applications because for example clothes may be caught in such high lens structures with the risk of damaging the lens structures.

It may be seen as an object of embodiments of the present invention to provide a modular maritime light source suitable for being mounted or integrated in life jackets and/or rafts.

It may be seen as a further object of embodiments of the present invention to provide a maritime light source offering improved light scattering properties using a flat lens structure.

It may be seen as a still further object of embodiments of the present invention to provide a maritime light source offering a plurality of selectable functionalities, such as manual or automatic water activation, internal or external water activation etc.

It may be seen as a still further object of embodiments of the present invention to provide a maritime light source having a low component count, suitable for mass production and flexible design features.

DESCRIPTION OF THE INVENTION

The above-mentioned objects are complied with by providing, in a first aspect, a maritime light source comprising a bottom housing, and a lid comprising a lens portion and a button portion, wherein the lens portion is adapted to scatter light from an associated light source over an angle of at least 180 degrees in a substantially uniform manner, and wherein the button portion comprises an integrated and flexible push button membrane wherein a water proof sealing is formed between the bottom housing and the lid.

The maritime light source may be an assembly comprising a plurality of components, such as housing elements, light source, electronic circuits, battery, switches and/or contacts etc., which in combination form the maritime light source. The maritime light source is particularly suitable for life jackets, rafts or other types of maritime life saving equipment.

The fact that light is scattered from the associated light source over an angle of at least 180 degrees means that the light source scatters at least over a hemisphere in a substantially uniform manner.

There are several advantages associated with the maritime light source of the present invention. One of these advantages is the lid which includes both an integrated lens and an integrated push button.

Thus, the lens portion forms an integral part of the lid. The lid preferably comprises first and second thermoplastic polymer layers, the first polymer layer being substantially stiffer than the second polymer layer. The second polymer layer may cover at least part of an interior surface portion of the first polymer layer.

The lens portion may form an integral part of at least part of the first, and stiffer, polymer layer, whereas the button portion may form an integral part of the second, and softer, polymer layer.

The first polymer layer may comprise an opening, said opening being substantially filled with at least part of the second polymer layer thereby defining the button portion in said opening. Moreover, at least part of the second polymer layer may form a sealing member, said sealing member forming the water proof sealing between the bottom housing and the lid.

The second polymer layer may comprise an opening, said opening being aligned with the lens portion in the first polymer layer so that light emitted by for example a light emitting diode (LED) may effectively be spread by the lens portion.

The lid may comprise a pair of through-going openings, and wherein an associated pair of sealing members are formed in the second polymer layer so as to form a pair of water proof sealings between the lid and an associated pair of contact pads arranged on a printed circuit board (PCB) positioned within the maritime light source.

In a second aspect, the present invention relates to a maritime light source comprising a housing, said housing comprising a lid comprising an integrated optical lens and an integrated push button. Preferably, an integrated optical lens forms part of a first polymer material. Moreover, the integrated push button preferably forms part of a second polymer material. The first and second polymer materials may have different colours. The first polymer material may be a substantially hard material, whereas the second polymer material may be a flexible material.

The maritime light source according to both the first and second aspects may further comprise an LED as a light source, said LED being adapted to be activated both manually and automatically.

In the third aspect, the present invention relates to a life jacket comprising a maritime light source according to the first or second aspects.

In a fourth and final aspect, the present invention relates to a comprising a maritime light source according to the first or second aspects.

BRIEF DESCRIPTION OF THE DRAWINGS

The present invention will now be explained in further details with reference to the accompanying figures, wherein.

While the invention is susceptible to various modifications and alternative forms, specific embodiments have been disclosed by way of examples. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to a maritime light source comprising two housing parts with a water proof sealing therebetween. One of the housing parts forms a lid comprising a lens portion and a button portion. The lens portion is adapted to scatter light at least over a hemisphere in a substantially uniform manner. The button portion comprises an integrated and flexible push button membrane.

The maritime light source of the present invention offers the following advantages:

A simple product with few components

High quality at low cost via intelligent design

A high margin for light output

Flexible color solution for individual costumers

Figure 1:
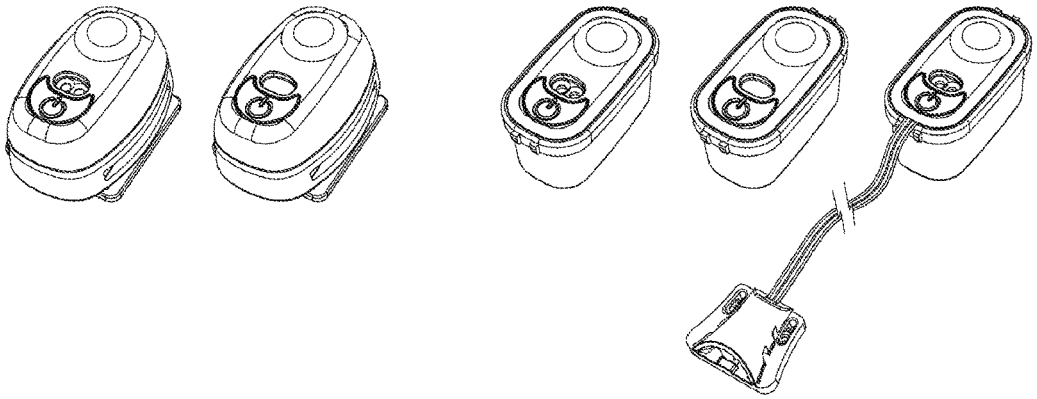
FIG. 1 illustrates various embodiments of the present invention.

The maritime light source according to the present invention has been implemented in six embodiments, namely:

A belt version with manual & water on/off activation (FIG. 1*a*)

A belt version with manual on/off activation (FIG. 1*b*)

A belt version with manual on/off activation and external water activation

A built-in version with manual & water on/off activation (FIG. 1*c*)

A built-in version with manual on/off activation (FIG. 1*d*)

A built-in version with manual on/off activation and external water activation (FIG. 1*e*)

Generally, the maritime light source according to the present invention comprises the following three elements:

A PCB including a battery

A top housing part

A bottom housing part

Optionally, an external water activation unit may be provided as well.

Figure 2:
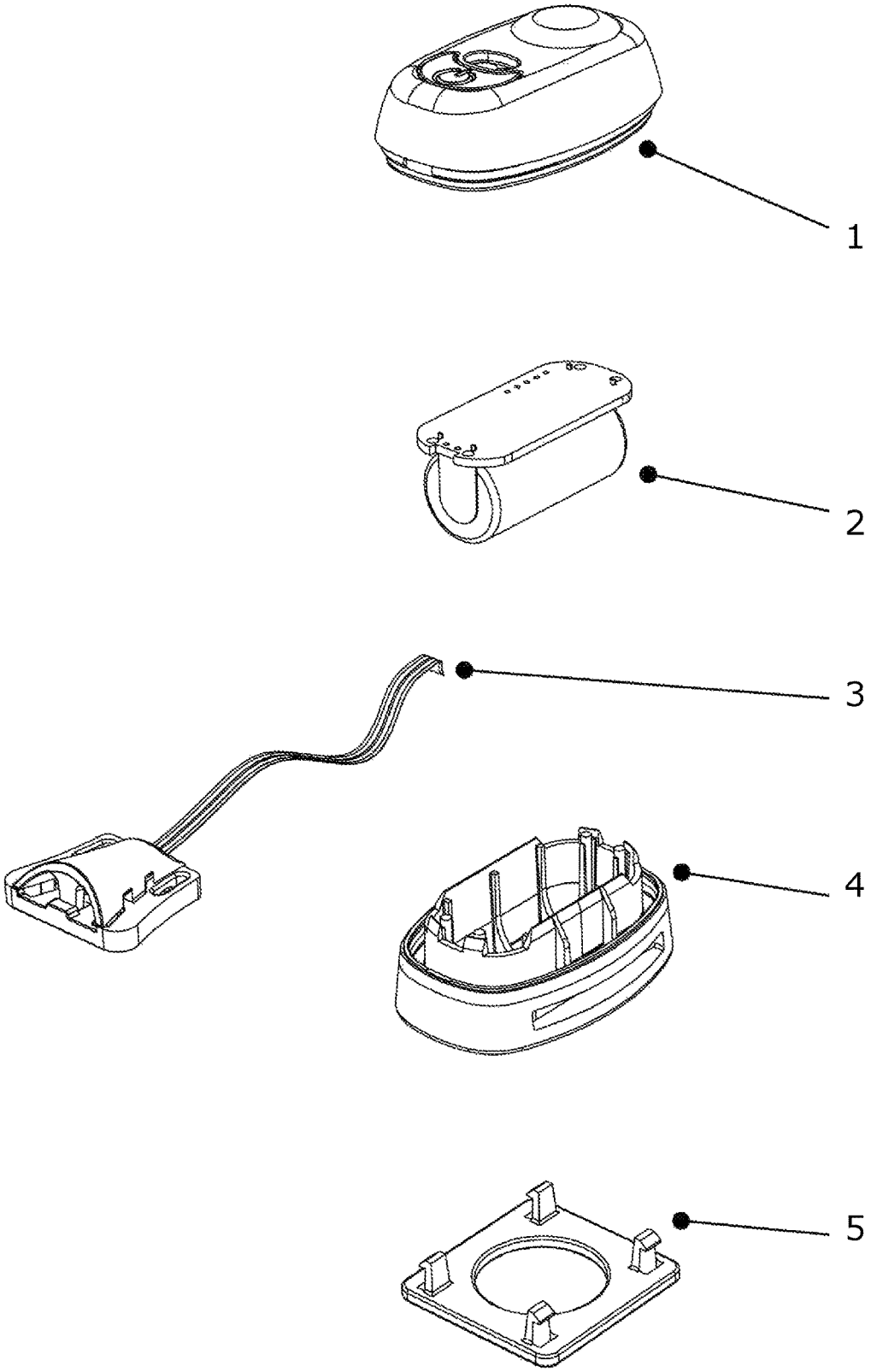
FIG. 2 shows an exploded view of a belt mountable light source.

Referring now to FIG. 2 a belt version with manual on/off activation and external water activation is depicted. The belt version comprises a top housing part 1, a PCB (incl. battery) 2, an external water activation unit 3, a bottom housing part 4 and an associated belt clips 5.

Figure 3:
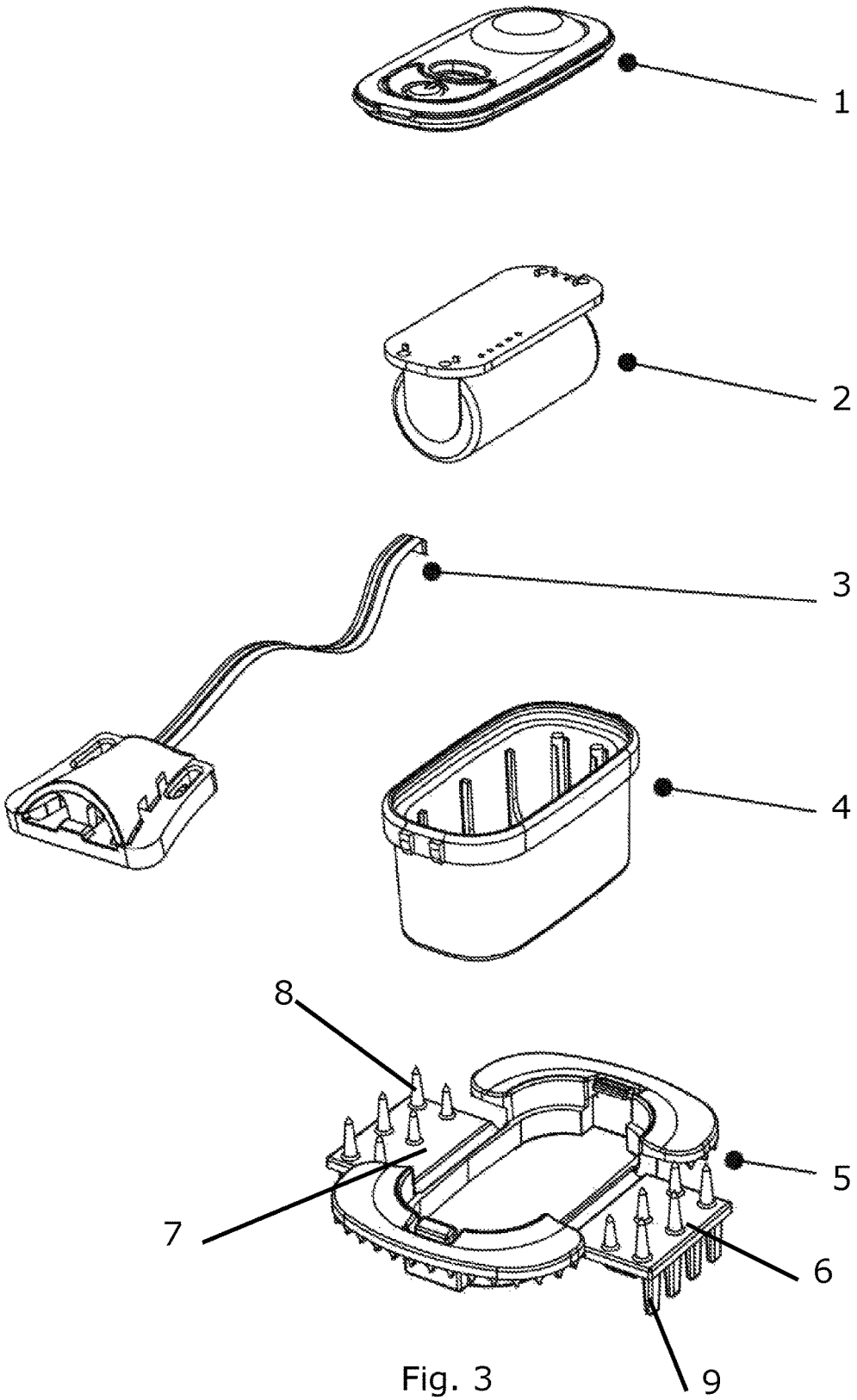
FIG. 3 shows an exploded view of a light source adapted to be built into a light jacket.

Referring now to FIG. 3 a built-in version with manual on/off activation and external water activation is depicted. The belt version comprises a substantially flat top housing part 1, a PCB (incl. battery) 2, an external water activation unit 3, a bottom housing part 4 and an associated mounting clips 5 into which the bottom housing part 4 is inserted. Upon insertion of the bottom housing part 4 into the mounting clips 5 the foldable wings 6, 7 of the mounting clips 5 rotates approximately 90 degrees so that the projections 8 penetrate into the life jacket material (not shown) whereas the support members 9 support a bottom surface of the bottom housing part 4.

Figure 4:
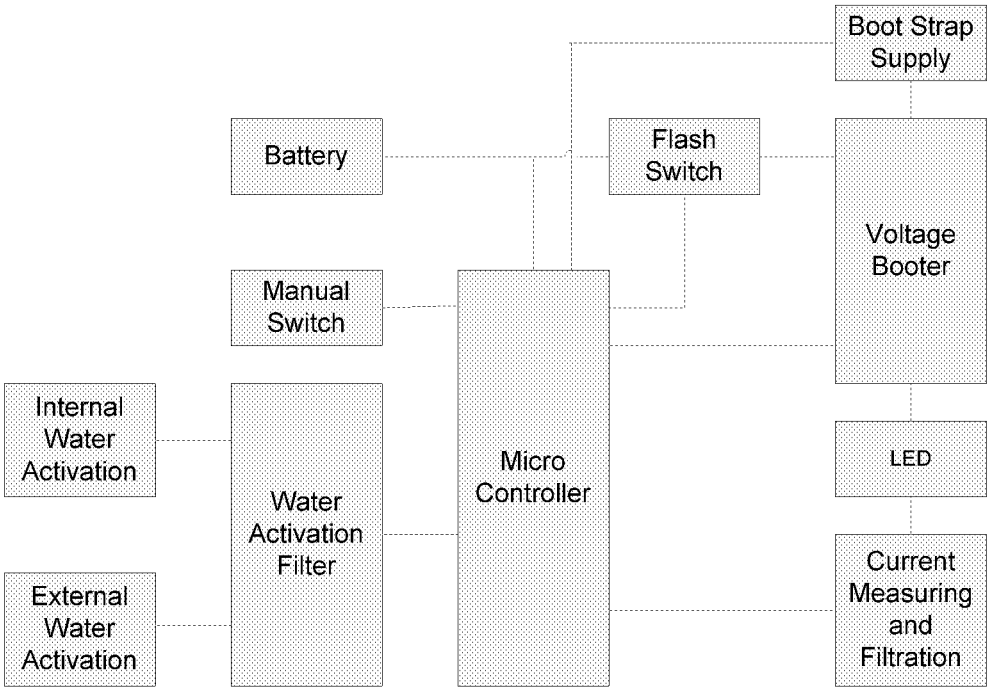
FIG. 4 shows a block diagram of the functionalities of the PCB.

A schematic block diagram of the PCB of the light source is shown in FIG. 4. The electrical circuitry of the PCB is adapted to perform the following:

1. Continuously monitor the presence of water.
2. Continuously monitor the manual on/off button.
3. Maintain a constant light-output from the Light Emitting Diode (LED) regardless off battery-voltage and temperature.
4. Control the pulse-length of the flashes to ensure conformity with regulations and optimize battery-life.
5. Enter extreme low-power sleep-state if water is not present and the light is not turned on manually.

Figure 5:
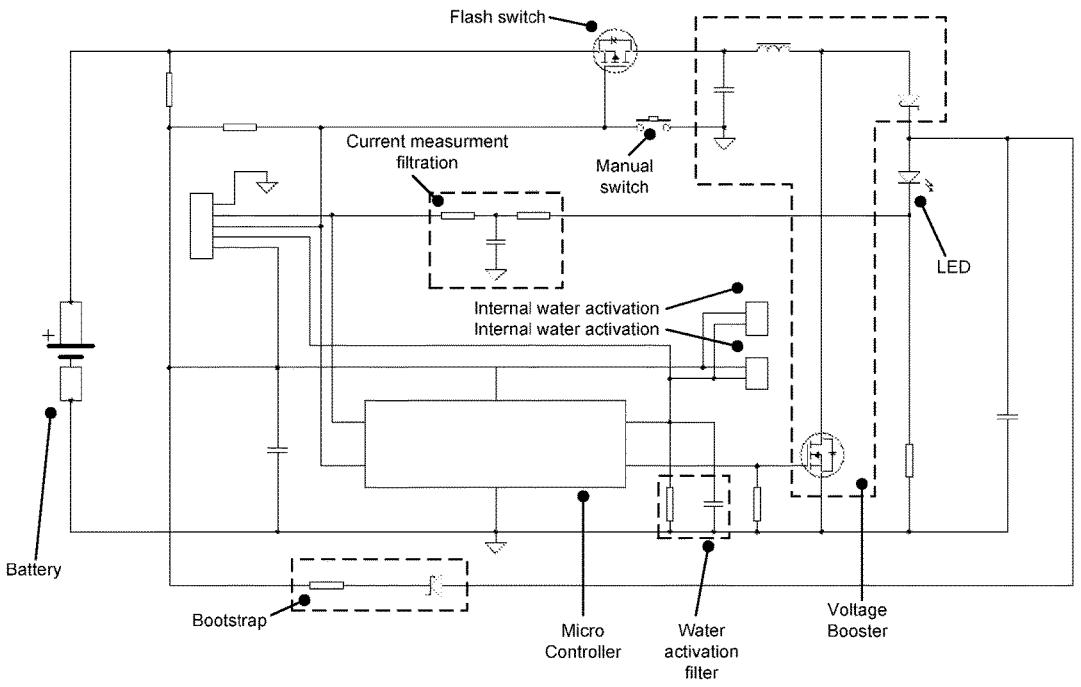
FIG. 5 shows the electrical layout of the PCB.

The underlying electrical circuitry of the PCB is shown in FIG. 5 (without component values). The electrical circuitry comprises the following elements:

1. An intelligent voltage booster with current feedback that:
   Converts the battery-voltage to a higher voltage suitable for the LED.

Incorporate sensory input to detect manual start/stop and presence of water.

Extreme low-power sleep mode that still is able to detect manual start and presence of water.

Flash switch that disables the voltage-booster when the light is off or in sleep-mode thus lowering energy consumption considerably.

Multiplexed inputs to controller that allows the flash switch and manual switch to share a controller input/output and thereby making it possible to use a smaller/cheaper microcontroller.

2. Bootstrap circuitry that allows the light source to function even though the battery voltage drops at the end of the battery life.

The maritime light source has a special startup mode that guaranties normal operation even when the light source is turned on after a long sleep period in cold environment. This startup mode will force a higher-than-normal current-draw for a few minutes after turn-on and thereby "waking up" the battery while ensuring a light-output that is above the given minimum requirements.

Figure 6:
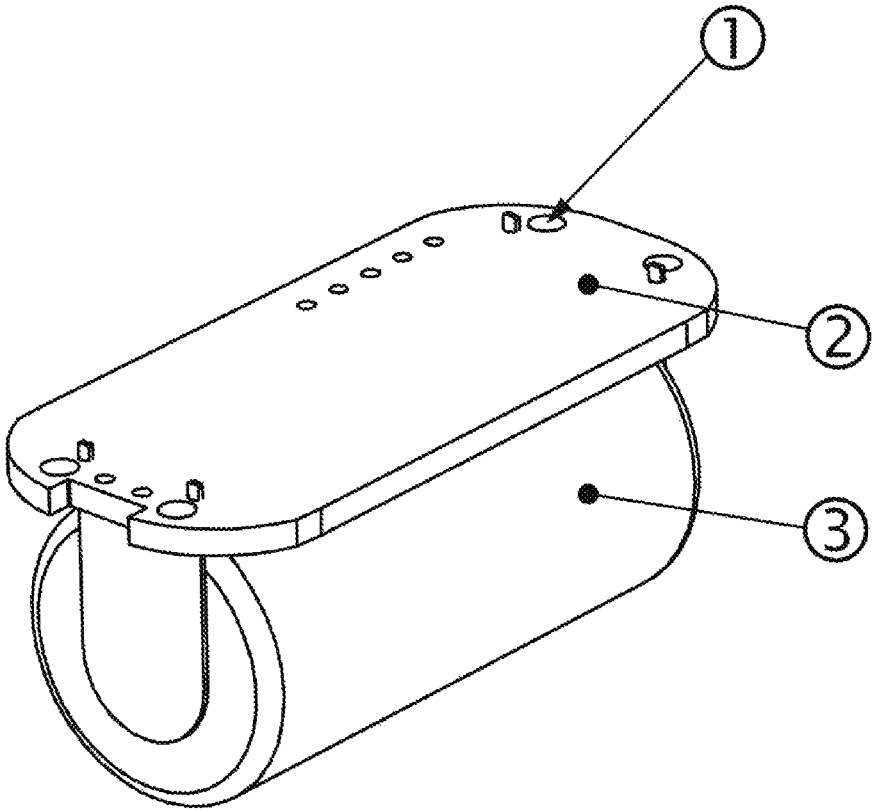
FIG. 6 shows the PCB with a battery attached thereto.

Referring now to FIG. 6 the PCB 2 itself has three main components—a battery 3, a microcontroller and a LED.

The battery, cf. reference numeral 3 in FIG. 6, is the power source for the life jacket light. The time requirement for functioning is 5 year. Also, the battery should be capable of operating in a wide temperature range from −30 to 65 degrees C. The battery used for the present invention may be a 3V LI-Mno2 primary lithium battery of 1250 mAh. Obviously, other types of batteries may be applicable as well. The battery has a PTC internal to ensure a high level of short circuit protection. The battery is soldered directly to the PCB.

As previously shown the PCB has a microcontroller implemented to control the board function. The microcontroller handles:

a) System sleep mode
b) Monitoring of manual activation
c) Monitoring of water activation both internal as external
d) Manual and water activation in one product
e) Dead-man button function
f) Control of flashing frequency for LED
g) Control of LED current for constant light output
h) Control of battery wake-up after year of standby use
i) Control of life flash after 20 hours of use
j) Control of battery test Re a) If no activity is needed the system enters a sleep mode function with a low standby use of 1 μA. The system is ready to wake up in case a certain function is needed. The microcontroller disables all pheripherals, shutdowns the LED driver circuit and minimizes all leakage currents. The light source needs, due to formal requirements, to be functional for a period of at least 5 year. The standby solution only uses 40 mAh which is less than 4% of battery capacity over a period of 5 years.

Re b) If a manual activation is detected the system wakes up and controls that the activation is valid and starts normal functioning. If the manual activation button is pressed again the system controls that the deactivation is valid and prepares for standby function.

Re c) The system is unique in that it may have water activation both internally and externally. The system can be activated by both internal and/or external water activation pads. If activation is detected the system wakes up and controls that the activation is valid and starts normal functioning. If the water is removed from the system the system controls that the deactivation is valid and prepares for standby function.

Re d) The system is unique due to the possibility of water activation and manual activation at the same time. If a person activates the light and jump into the water the system detects the presence of water. If the light is taken out of the water the light stops flashing. Moreover, when the light is in the water the person can decide to manually shut-down the light in order to save battery.

Re e) if a person has shutdown the light when the person is in the water the life jacket light will automatically re-ignite after 15 minutes if it is still in the water. If the person shutdowns the light again, the system will again re-ignite after 15 minutes if water is present. The automatic re-ignition of the light is done in order to avoid that a person shutdowns the light, passes out and thereby not having a chance to be saved in proper time.

Re f) The microcontroller ensures a correct flashing of the LED. It turns on the LED for 320 ms and ensures 52 flashes pr. minute. This is done in order to fulfill the official reguirements.

Re g) The microcontroller controls the LED with a constant current profile. This is done to ensure a correct light intensity from the LED in all temperature profiles and ageing profiles.

The system ensures a minimum of 1 candela to fulfill both the maritime and aviation demands Re h) When the system wakes up from sleep, the battery may need exercising after up to 5 year of storage. The system loads the battery with high current pulses the first 5 minutes of use in order to exercise and improve battery performance.

Re i) If the system has been flashing in 20 hours the battery is almost empty. The system then goes into a flash mode where the LED is flashed every 5 seconds with a high intensity, but short flash. This ensures that the person can still be found in the dark after 48 hours.

Re j) It is possible to control the functioning of the system. If the manual on/off button is held down for 8 seconds the system enters a short test mode. The test mode test the functioning of the battery and the LED and report the status back to the user with 3 short flashes for system ok or 5 long flashes in case an error has been detected.

The LED ensures that a correct amount of light intensity and color is emitted. The LED is soldered directly to the PCB with a thermal construction to ensure the best performance of the LED at high temperatures. The system is prepared for various types of LEDs in order to be on the front edge of the LED development.

The housing of the light source may be implemented in two embodiments. One embodiment is adapted to be integrated with the life jacket whereas the other embodiment is adapted to be mounted on a belt. Both embodiments comprise two mechanical parts—a housing lid and a housing bottom. The two lids offer a plurality of functionalities. Both lids are manufactured using a two component molding, namely a hard top molding for product strength and a soft molding for button, water tightness and product color variation.

Figure 7:
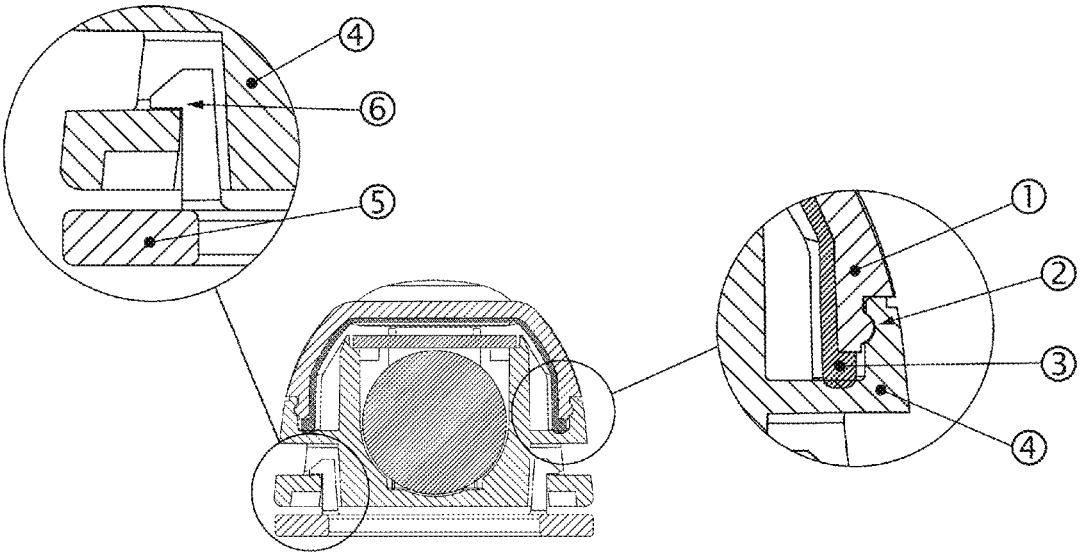
FIG. 7 illustrates how the belt version of the light source is assembled.
Figure 8:
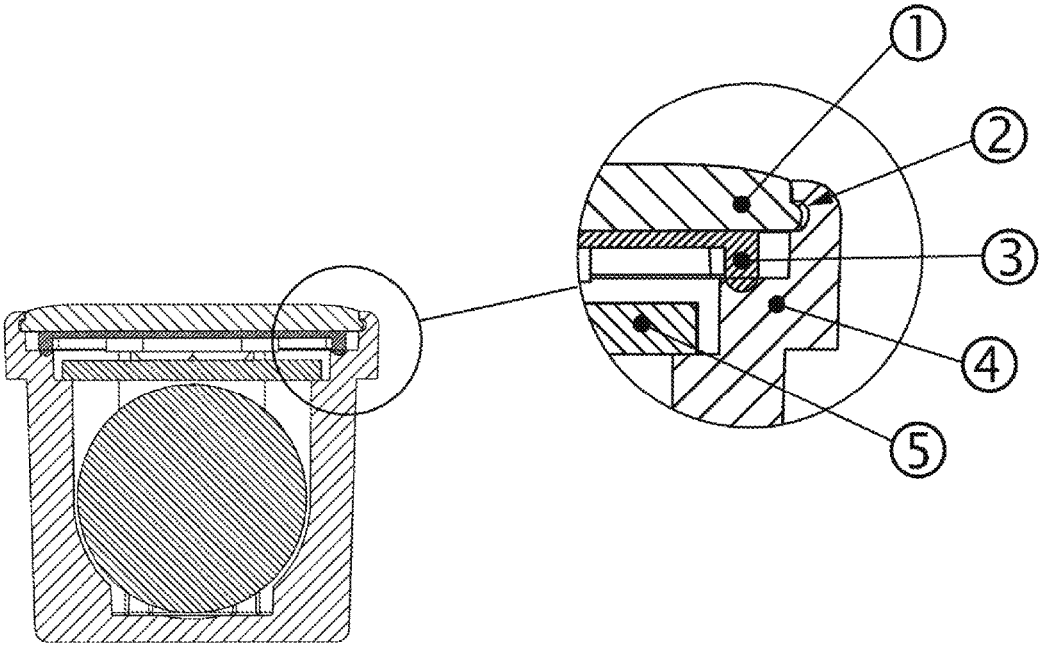
FIG. 8 illustrates how the built-in version of the light source is assembled.

There are several advantages associated with the housing of the light source—the main advantages being:

a) Snap connection assembly
b) Unique flat lens for 180 degree light emission
c) Internal water activation, easy sealing to PCB
d) Manual button implementation in lid sealing e) Thermoplastic elastomer sealing for water sealing, button and product color f) Thermoplastic elastomer activation wire Re a) The lid of the two embodiments are snapped together with the bottom housing, cf. FIGS. 7 and 8. In FIG. 7 (belt version) the lid 1 is snapped to the bottom housing 4 by engaging a protrusion of the lid with a corresponding recess 2 of the bottom housing 4. A polymeric sealing 3 is provided between the lid and the bottom housing. In FIG. 8 (built-in version) the lid 1 is snapped to the bottom housing 4 by engaging a protrusion of the lid with a corresponding recess 2 of the bottom housing 4. A polymeric sealing 3 is provided between the lid and the bottom housing. The PCB 5 is also shown in FIG. 8.

The assembling of the light source becomes easy and cheap. Before snapping the two parts together a mechanical control mechanism ensures correct polarity and fixing. When the two parts are snapped together the PCB is aligned with the focal point of the lenses whereby no further adjustments are needed. The thermoplastic elastomer sealing provides a counter pressure on the snap ensuring the correct water tightness.

Figure 9:
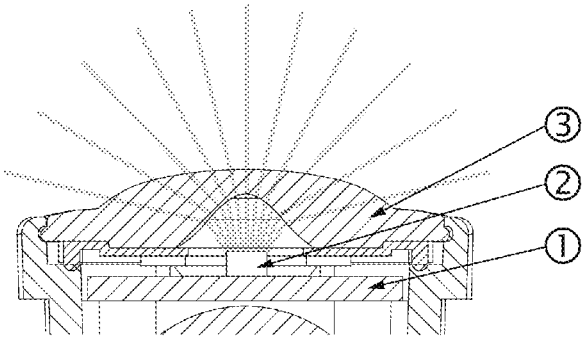
FIG. 9 shows a cross-sectional view of the integrated lens of the lid.

Re b) The lens construction in the life jacket light according to the present invention is unique in that the lens has been integrated with the housing lid. The lens has a very small height which is highly advantageous on sea. Nothing can be stuck on the lens due to its small size. The snap ensures that the LED is correctly positioned in the focal point of the lens. Normally LEDs have ½ intensity angles of 120 degrees. The lens ensures an almost linear light output over 180 degrees. The lens 3, the LED 2 and the PCB 1 are all shown in FIG. 9.

Figure 10:
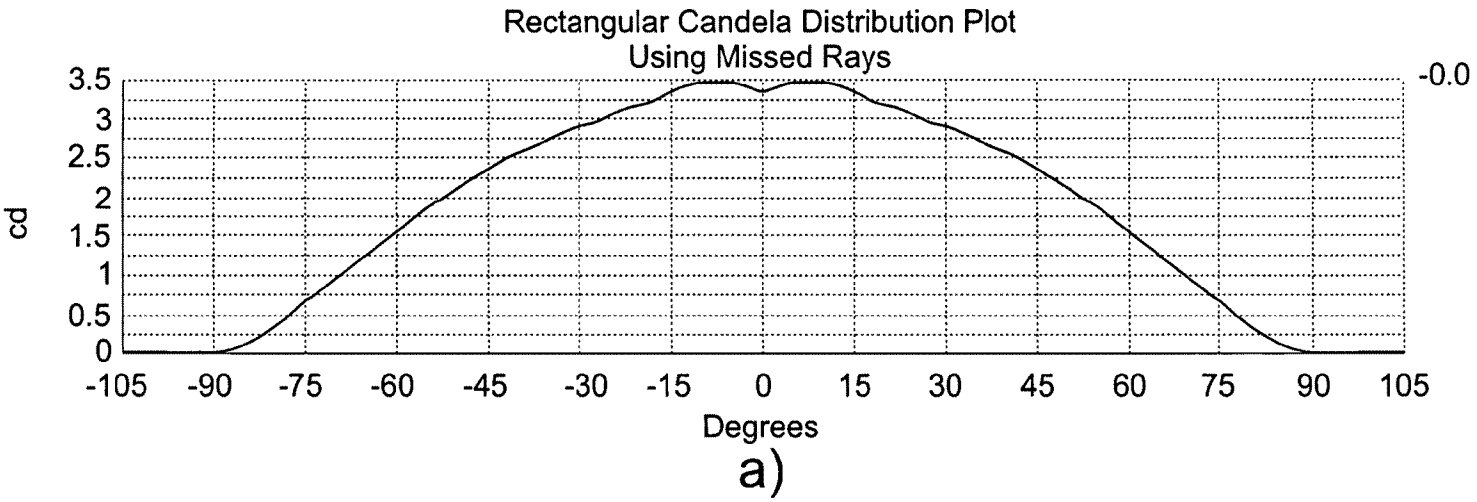
FIG. 10 shows a comparison of the light distribution of the a LED without a lens a) and with a lens b)
Figure 10:
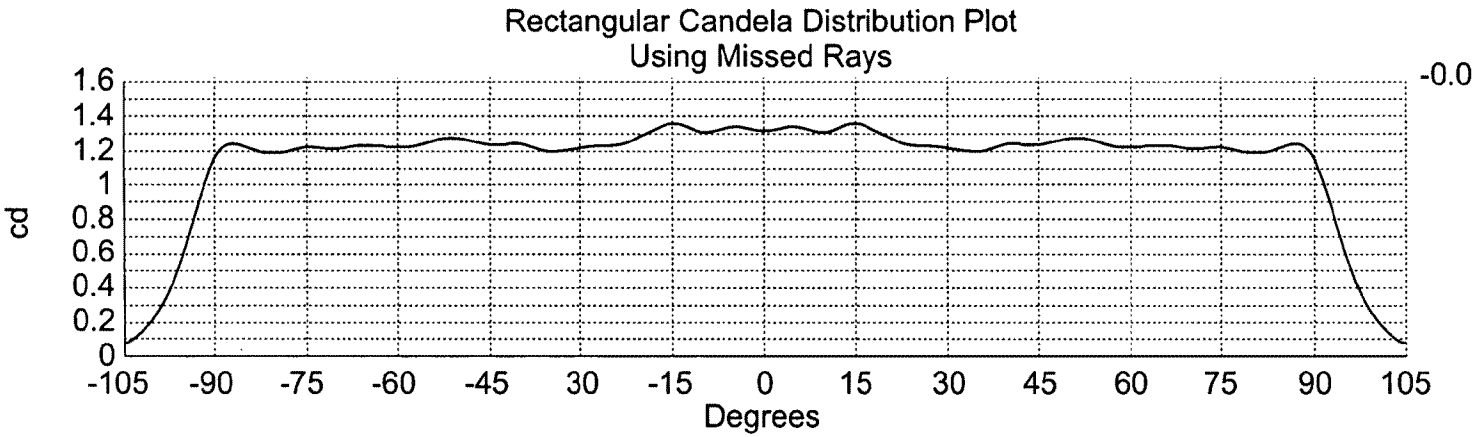

A standard LED output profile is depicted in FIG. 10*a*, whereas the light output shaped by the lens is shown in FIG. 10*b*. The placement in the focal point is of absolute importance. By comparing FIGS. 10*a* and 10*b* the effect of the lens is evident in that the light intensity becomes essentially constant over an angle of 180 degrees.

Figure 11:
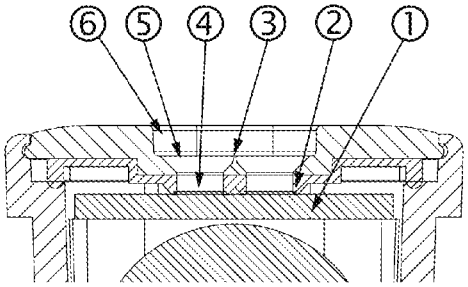
FIG. 11 shows a cross-sectional view of the water activation zone.

Re c) Referring now to FIG. 11 internal water activation may optionally be implemented with two small cone holes 5,6 through the lid. An ion barrier 3 is designed in the lid to ensure that humidity and creepage current cannot activate the light. The internal water activation is designed so that droplets of water cannot activate the light; it has to be immersed into water. Ones it has been immersed into water droplets attach to the activation. These droplets need to be shaken rather hard in order to be removed. This design ensures that for example flashing in high sea or heavy rain is avoided. The water tightness between the PCB water activation pads 4 and the lid is maintained by the thermoplastic elastomer sealing 2. A high mechanical pressure is provided between the PCB 1 and the thermoplastic elastomer sealing 2 when the bottom housing and the lid are snapped together.

Figure 12:
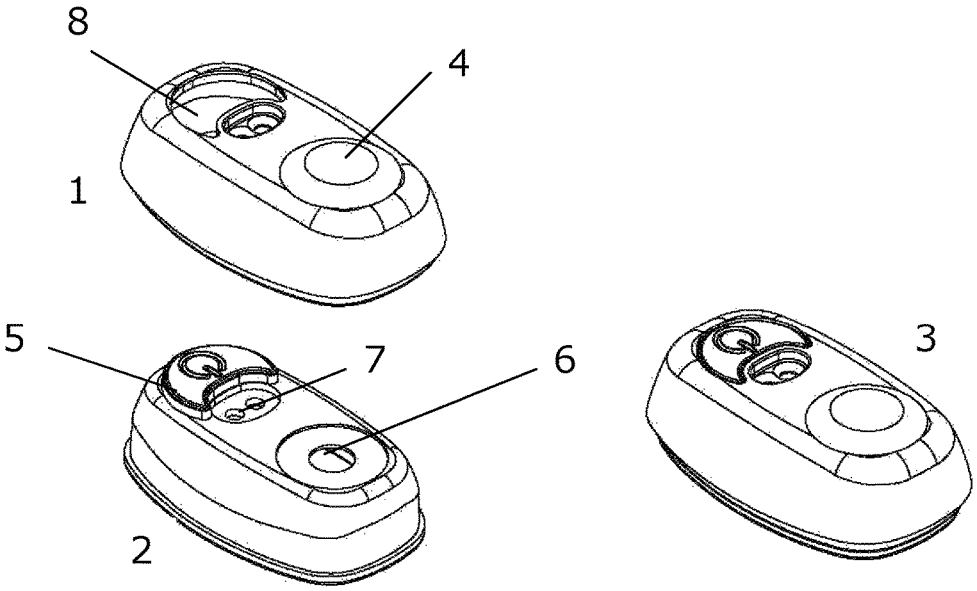
FIG. 12 shows the two layer concept of the lid.
Figure 12:
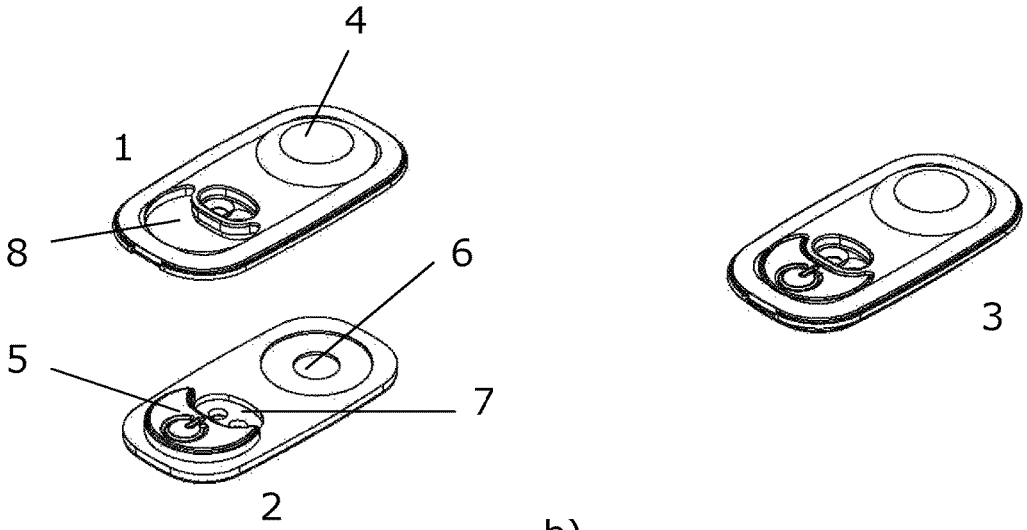

Re d) The lid preferably comprises an integrated button which upon activation activates the light. The button is designed and implemented to be flexible so that a pressure applied on the top of the button is transferred to a switch placed on the PCB. The flexibility of the thermoplastic elastomer works as a spring and release the switch when no pressure is applied to the button. The spring effect is provided because the thermoplastic elastomer material is molded onto the housing and has a strong adherence effect. Referring now to FIG. 12 a lid to a belt version is shown in FIG. 12*a*, whereas FIG. 12*b* shows a lid to a built-in version of the light source. The left side of FIGS. 12*a* and 12*b* show exploded views of the lids, whereas the right side of FIGS. 12*a* and 12*b* show the final lids 3. As shown in the left portions of FIGS. 12*a* and 12*b* the lids are manufactured by a hard polymer material 1 and a flexible polymer material 2. The hard polymer part of the lid has an integrated lens portion 4 which is adapted to spread light, in a homogeneous manner, over an angle of approximately 180 degrees. The flexible polymer material 2 has an integrated button 5 which is adapted to fit into the opening 8 of the hard polymer part. Moreover, the flexible polymer material 2 comprises an opening 6 for light penetration and a pair of openings 7 for water activation of the light.

Re e) The thermoplastic elastomer is molded onto the entire inner side/surface of the housing lid. It is manufactured in a two component molding. The thermoplastic elastomer works, as previously mentioned, as the button. Simple engraving may optionally be provided into the button. The thermoplastic elastomer forms a water proof sealing, provides a counter pressure and provides water activation holes to the PCB.

Re f) The thermoplastic elastomer enables a simple water proof sealing for the external water activation cover. The use of a 0.1 mm flexible PCB (flexprint) in pressure on one site with the thermoplastic elastomer provides a water proof sealing if the product is submerged down to 35 cm under the water.

The maritime light source according to the present invention has been implemented in two embodiments. One embodiment is adapted to be integrated to the life jacket—another embodiment is adapted to be mounted in a belt. The two embodiments each comprises two mechanical parts, a housing lid and a housing bottom. The two bottom housings share many functions.

Advantages of the general construction are as follows:

a) Snap connection to belt version b) Simple lock version for built-in version c) PCB fixation d) Mechanical protection for battery Re a) The life jacket light can be mounted on a belt trap whereby the life jacket light can be easily replaced after 5 years as required by official demands. The connection to the belt is provided by snapping the bottom housing onto the belt clips. An audible click sound indicates when the belt clips and the bottom housing are correctly attached. The belt clips are preferably made in POM in order to obtain a high flexibility and a high strength.

Re b) The built-in clips have a unique mechanical construction. The built-in clips have two lips on the top to ensure that it will not fall through the mounting hole. The back site of each of the lips is equipped with spikes that ensure a strong fixture to the surface. When assembling the clips into a hole in the life jacket light, the clips wings will fold together. Moreover, the bottom housing is fixed to the large spikes which penetrates into the life jacket and finally fixes the light to life jacket. The end tabs on the bottom housing snaps into the clips and ensure a stabile fixing.

Re c) The PCB is mounted in the bottom housing. A total of four fixation elements lead the PCB into a cradle. The fixation elements ensure that the PCB and the LED are in the correct focal point of the lens. Additional supporting legs hold the PCB in its correct position.

Re d) In the bottom of the housing the supporting legs also support the battery so it can withstand accidental drops from high altitudes. A lowering into the bottom of the housing provides further fixation of the battery.

Figure 13:
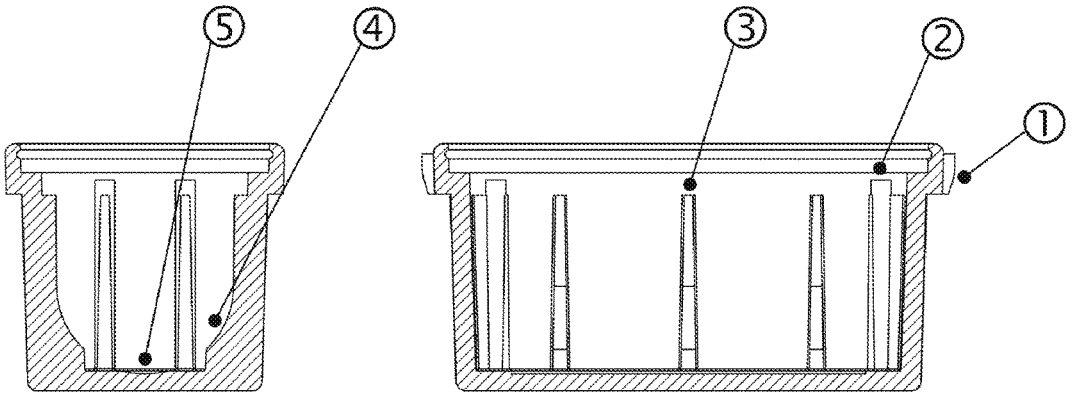
FIG. 13 shows different support structures of the bottom housing.
Figure 13:
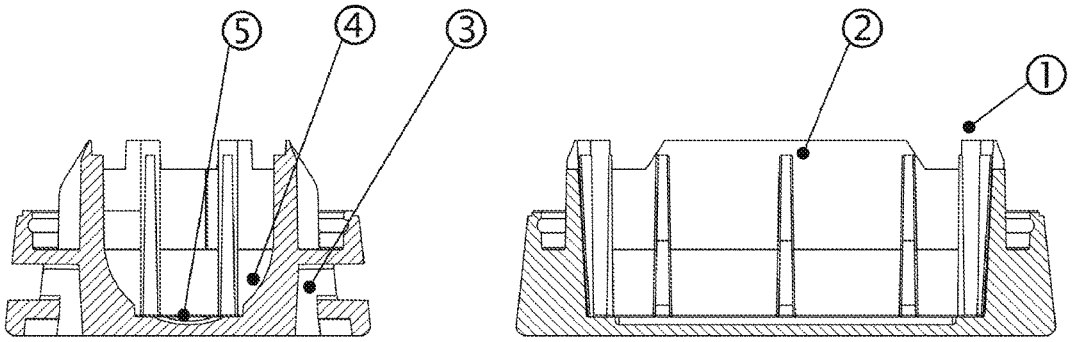

Referring now to FIG. 13*a* the bottom housing 1 comprises fixation elements 2, supporting legs 3 and a lowering 5. Moreover, the bottom housing comprises a curved lower portion 4 for supporting the battery.

Referring now to FIG. 13*b* the bottom housing for the belt version comprises fixation elements 1, supporting legs 2 and a lowering 5. Moreover, the bottom housing comprises a curved lower portion 4 for supporting the battery. Also, the belt version comprises fixation snapping means 3 for snapping the housing to a belt clips.

Figure 14:
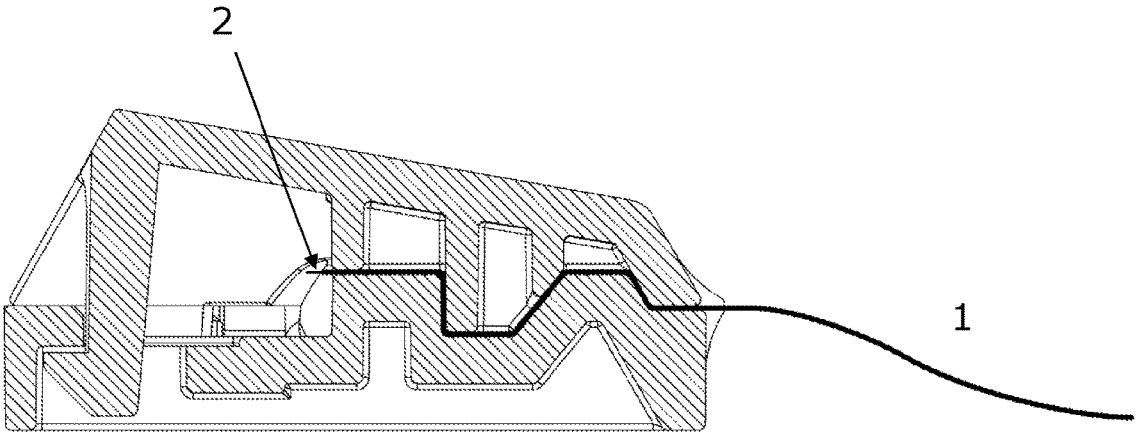
FIG. 14 shows an external water activation unit.
Figure 14:
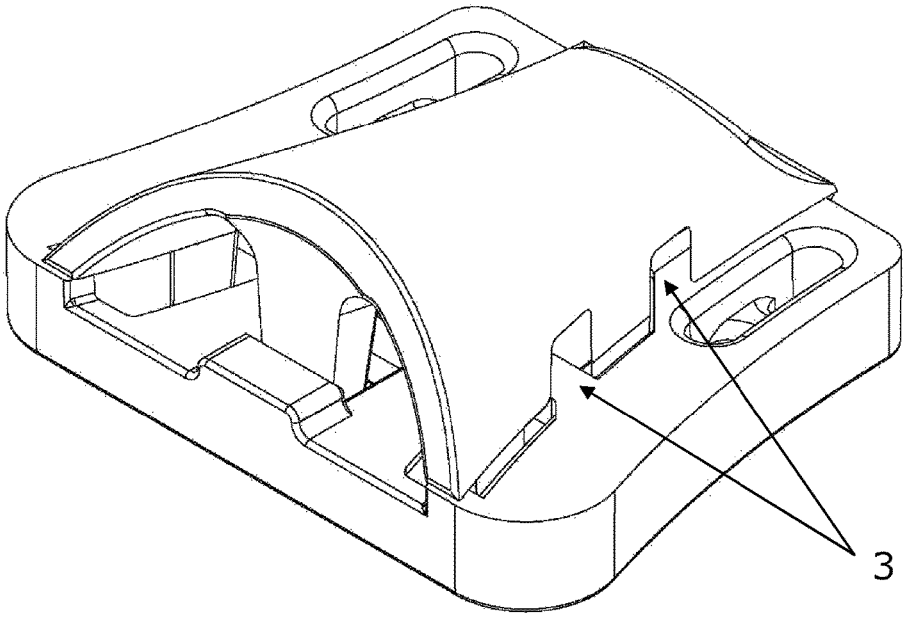

Referring now to FIG. 14*a* the external water activation cover is adapted to be sowed into life jackets. The thin flexible wire 1 has a high strength and carries the two conductive sensing parts. The wires are stripped near their ends 2 and they are placed in open space to prevent that creapage currents activate the life jacket light. The wires 1 are easy assembled into the cover. A small cradle fixates the wire and when closing the cover the wire is mechanical fixed. The cover is designed so that rain can not activate the light. Two air outlets (3 in FIG. 14*b*) are placed in the top of the cover. When the cover is immersed into water the water covers the sensors. The air in the cover escapes through the air outlets.

The invention claimed is:

1. A maritime light source comprising:

a bottom housing, a lid comprising a lens portion and a button portion, wherein the lens portion is adapted to scatter light from an associated light source over an angle of at least 180degrees in a substantially uniform manner, and wherein the button portion comprises an integrated and flexible push button membrane, and a water proof sealing between the bottom housing and the lid, wherein the lid comprises first and second thermoplastic polymer layers, the second thermoplastic polymer layer molded to the first thermoplastic polymer layer, the first thermoplastic polymer layer being substantially stiffer than the second thermoplastic polymer layer, the second thermoplastic polymer layer conformally covering a majority of an interior surface portion of the first thermoplastic polymer layer, wherein the lens portion is an integral part of the first thermoplastic polymer layer, and wherein the button portion is an integral part of the second thermoplastic polymer layer and protrudes through the first thermoplastic polymer layer.

2. The maritime light source according to claim 1, wherein the first thermoplastic polymer layer comprises an opening, said opening being substantially filled with at least part of the second thermoplastic polymer layer thereby defining the button portion in said opening.

3. The maritime light source according to claim 1, wherein at least part of the second thermoplastic polymer layer forms a sealing member, said sealing member forming the water proof sealing between the bottom housing and the lid.

4. The maritime light source according to claim 3, wherein the second thermoplastic polymer layer comprises an opening, said opening being aligned with the lens portion in the first thermoplastic polymer layer.

5. The maritime light source according to claim 1, wherein the lid comprises a pair of through-going openings, and wherein an associated pair of sealing members are formed in the second thermoplastic polymer layer so as to form a pair of water proof sealings between the lid and an associated pair of contact pads arranged on a printed circuit board positioned within the maritime light source.

6. The maritime light source according to claim 1, further comprising an LED as a light source, said LED being adapted to be activated both manually and automatically.

7. A maritime light source comprising:

a housing, said housing comprising a lid, the lid comprising an integrated optical lens and an integrated push button, wherein the integrated optical lens is an integral part of a first polymer layer, and wherein the integrated push button is an integral part of a second polymer layer and protrudes through the first polymer layer, the second polymer layer molded to the first polymer layer to conformally cover a majority of an interior surface portion of the first polymer layer, the first polymer layer being substantially stiffer than the second polymer layer.

8. The maritime light source according to claim 7, wherein the first and second polymer layers have different colours.

9. The maritime light source according to claim 7, wherein the first polymer layer is a harder material than the second polymer layer, and wherein the second polymer layer is a more flexible material than the first polymer layer.

10. The maritime light source according to claim 7, further comprising an LED as a light source, said LED being adapted to be activated both manually and automatically.

11. A life jacket comprising:

a maritime light source comprising a bottom housing, a lid comprising a lens portion and a button portion, wherein the lens portion is adapted to scatter light from an associated light source over an angle of at least 180 degrees in a substantially uniform manner, and wherein the button portion comprises an integrated and flexible push button membrane, and a water proof sealing between the bottom housing and the lid, wherein the lid comprises first and second thermoplastic polymer layers, the second thermoplastic polymer layer molded to the first thermoplastic polymer layer, the first thermoplastic polymer layer being substantially stiffer than the second thermoplastic polymer layer, the second thermoplastic polymer layer conformally covering a majority of an interior surface portion of the first thermoplastic polymer layer, wherein the lens portion is an integral part of the first thermoplastic polymer layer, and wherein the button portion is an integral part of the second thermoplastic polymer layer and protrudes through the first thermoplastic polymer layer.

12. A life jacket comprising:

a maritime light source comprising a housing, said housing comprising a lid, the lid comprising an integrated optical lens and an integrated push button, wherein the integrated optical lens is an integral part of a first polymer layer, and wherein the integrated push button is an integral part of a second polymer layer and protrudes through the first polymer layer, the second polymer layer molded to the first polymer layer to conformally cover a majority of an interior surface portion of the first polymer layer, the first polymer layer being substantially stiffer than the second polymer layer.

13. A raft comprising:

a maritime light source comprising a bottom housing, a lid comprising a lens portion and a button portion, wherein the lens portion is adapted to scatter light from an associated light source over an angle of at least 180 degrees in a substantially uniform manner, and wherein the button portion comprises an integrated and flexible push button membrane, and a water proof sealing between the bottom housing and the lid, wherein the lid comprises first and second thermoplastic polymer layers, the second thermoplastic polymer layer molded to the first thermoplastic polymer layer, the first thermoplastic polymer layer being substantially stiffer than the second thermoplastic polymer layer, the second thermoplastic polymer layer conformally covering a majority of an interior surface portion of the first thermoplastic polymer layer, wherein the lens portion is an integral part of the first thermoplastic polymer layer, and wherein the button portion is an integral part of the second thermoplastic polymer layer and protrudes through the first thermoplastic polymer layer.

14. A raft comprising:

a maritime light source comprising a housing, said housing comprising a lid, the lid comprising an integrated optical lens and an integrated push button, wherein the integrated optical lens is an integral part of a first polymer layer, and wherein the integrated push button is an integral part of a second polymer layer and protrudes through the first polymer layer, the second polymer layer molded to the first polymer layer to conformally cover a majority of an interior surface portion of the first polymer layer, the first polymer layer being substantially stiffer than the second polymer layer.

* * * * *